United States Patent [19]

Georgel et al.

[11] 3,974,737

[45] Aug. 17, 1976

[54] SEMI-AUTOMATIC WEAPON-LOADING SYSTEM

[75] Inventors: Jean Georgel; Maurice Vilain, both of Paris, France

[73] Assignee: Thomson-CSF, Paris, France

[22] Filed: Dec. 5, 1974

[21] Appl. No.: 529,943

[30] Foreign Application Priority Data

Dec. 7, 1973 France ..... 73.43763

[52] U.S. Cl. ..... 89/1.802; 89/1.805; 214/1 BC; 214/1 BD; 214/1 D

[51] Int. Cl.[2] ..... F41F 9/00

[58] Field of Search ..... 89/1.801, 1.802, 1.803, 89/1.804, 1.805; 214/1 D, 38 B, 2.5, 1 BC, 1 BD, 1 CM, 1 P, 1 QF

[56] References Cited

UNITED STATES PATENTS

| | | | |
|---|---|---|---|
| 3,071,269 | 1/1963 | Moulds | 214/1 D X |
| 3,087,630 | 4/1963 | Karnow et al. | 214/1 D |
| 3,095,981 | 7/1963 | Thorson | 214/1 D |
| 3,101,026 | 8/1963 | Jacobson et al. | 89/1.805 |
| 3,316,808 | 5/1967 | Mals | 89/1.804 |
| 3,484,004 | 12/1969 | Hughey | 214/1 D X |
| 3,786,715 | 1/1974 | Even | 89/1.805 |
| 3,799,362 | 3/1974 | Oswald et al. | 214/1 D |

*Primary Examiner*—David H. Brown
*Attorney, Agent, or Firm*—Karl F. Ross; Herbert Dubno

[57] ABSTRACT

A frame open on one side, including two parallel missile-supporting shelves interconnected on the opposite side, is mounted on a transport vehicle so as to be swingable about three mutually orthogonal axes for alignment of these shelves with respective ramps on a launching vehicle upon a docking of the two vehicles. The missiles are fastened to their shelves by pivoted clamps transferring them to the adjoining ramp faces by swinging about axes parallel to the longitudinal shelf and ramp edges. Locking elements on the ramp faces engage the missiles, or their containers, whereupon they are released from the clamps of the supporting frame.

10 Claims, 9 Drawing Figures

SEMI-AUTOMATIC WEAPON-LOADING SYSTEM

FIELD OF THE INVENTION

The present invention relates to a semi-automatic weapon-loading system, more particularly to a system designed to place projectiles such as missiles or rockets on fixed or mobile launching ramps, several of which are mounted on a turret.

BACKGROUND OF THE INVENTION

Various loading devices and systems are known for this purpose. Some are mainly constituted by a hoisting mechanism serving to deposit the missile on its ramp, the final stage of this positioning being carried out under the guidance of an operator. In order to facilitate such positioning, the emplacement of the missile on the ramp may have such a shape that the missile places itself in its correct position on the frame of the ramp. However, this manner of loading is not suitable for a turret having superposed missile emplacements on each side.

Other loading devices, employed above all in fixed installations, place a missile support in line with the ramp and cause the missile to slide from its support toward the ramp. However, this single action requires an extremely precise positioning of the support with respect to the ramp.

OBJECT OF THE INVENTION

The object of our present invention is to provide an improved loading system avoiding the drawbacks of the prior art.

SUMMARY OF THE INVENTION

In accordance with the present invention we provide a projectile holder mounted on a carrier, preferably a vehicle, with freedom of independent rotation about three mutually orthogonal axes, the holder comprising an elongate horizontal member positionable alongside a launching ramp with alignment of their respective surfaces for the transfer of a projectile from one surface to the other. The surface of the holder member is provided with pivoted clamping means swingable toward the aligned ramp surface which in turn has locking means engageable with the projectile preparatorily to release of the clamping means.

Pursuant to a more particular feature of our invention, the holder member is a shelf with upper and lower projectile-carrying surfaces, two such shelves forming part of an open-sided frame and being interconnected for joint pivotal and translational movement. The frame, for this purpose, is hinged to a pair of parallel levers forming part of an articulated linkage which includes a pair of gripper bars engageable with fittings on the ramp mount; the levers, whose joints are immobilizable with reference to the remainder of the linkage during the initial positioning, are unlocked after slideways on the shelves have come to rest on supporting pins projecting from the ramp edges whereupon the frame can be slid into final alignment.

BRIEF DESCRIPTION OF THE DRAWING

The above and other features of our invention will now be described in detail with reference to the accompanying drawing in which.

Figure 1:
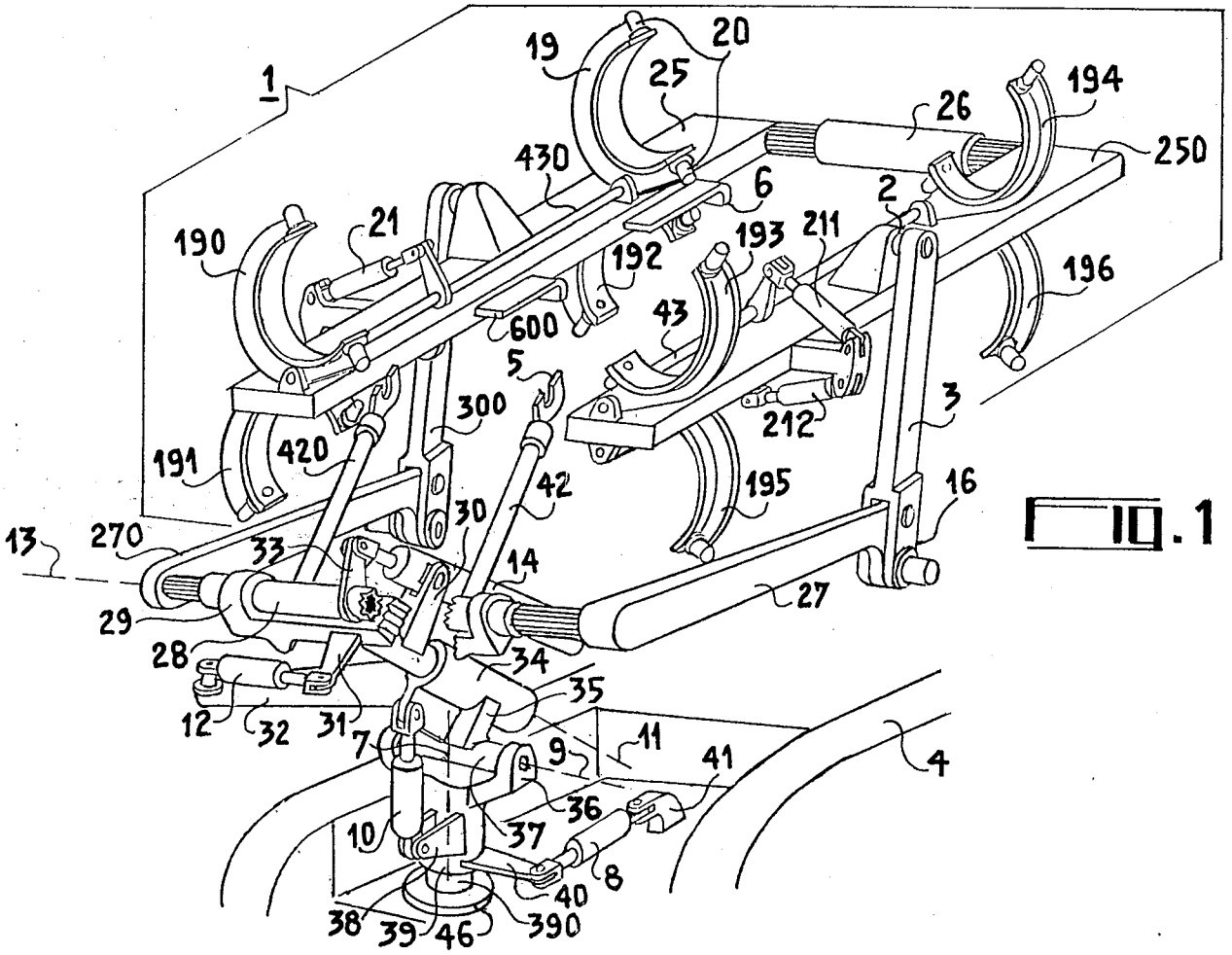
FIG. 1 is an isometric view of a mobile missile-support frame forming part of a loading system according to our invention.

In the embodiment of the invention described hereinafter, the loading system is mounted partly on a carrier vehicle which moves about and places itself in a well determined position with respect to the vehicle carrying the launching ramp on which the missiles must be positioned. Though the drawing shows only the bare missiles, the underlying principles of the invention are equally applicable to missiles transported on the carrier vehicle in containers.

FIG. 1 shows a frame 1 designed to carry missiles and mounted on a carrier vehicle 4.

This frame is open at one side and is provided with means described hereinafter for hooking the missiles thereto, the present embodiment allowing four missiles to be transported and then transferred to the launching ramp. As mentioned above, this frame 1 must be placed in a certain position with respect to the launching ramp before the missiles can be transferred; it is therefore provided with mounting means imparting thereto a number of degrees of freedom which enable it to assume the required transfer position.

Figure 2:
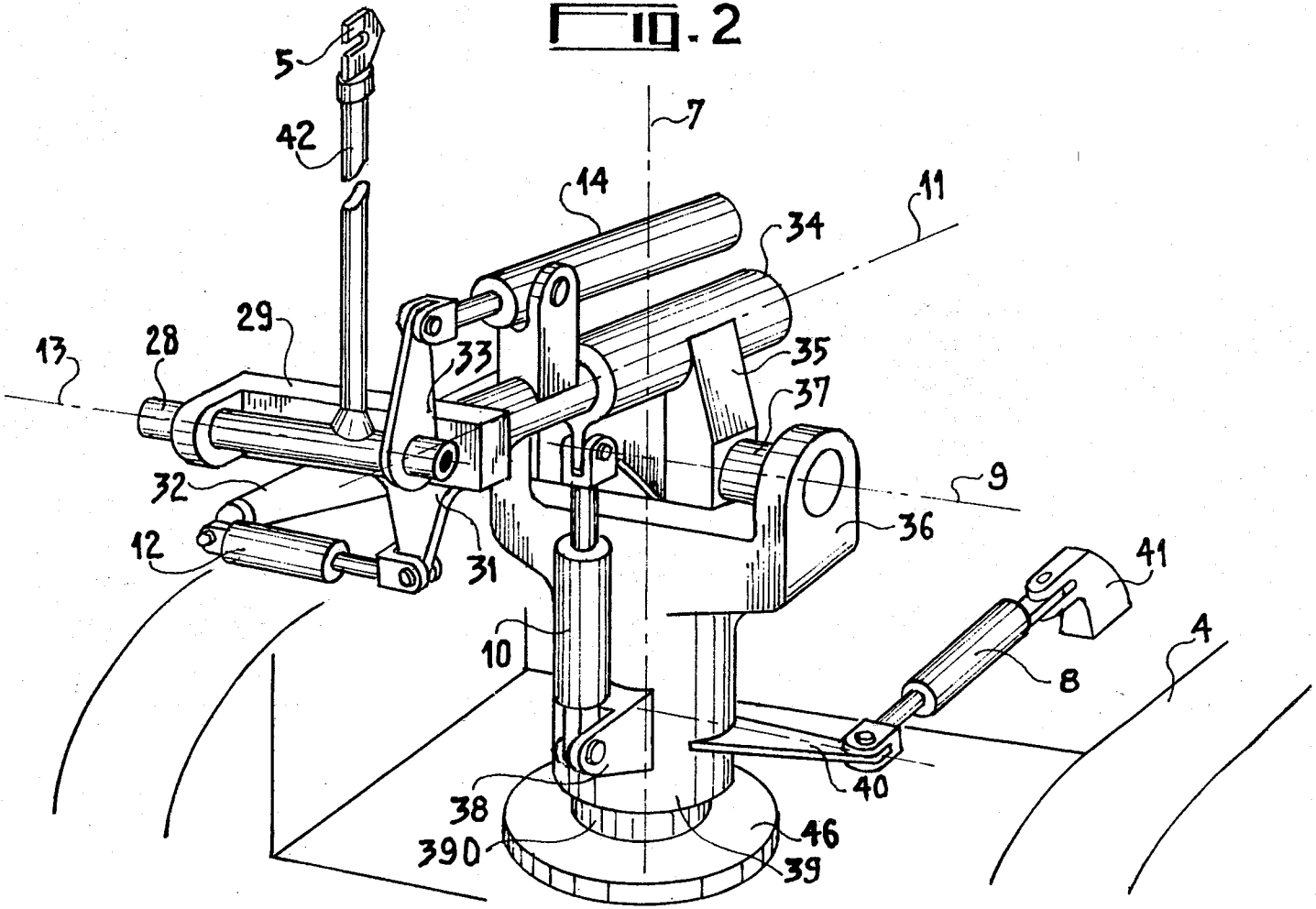
FIG. 2 is an isometric detail view of the frame-shifting mechanism.

This frame 1, constituted by two parallel longitudinal metal members or shelves 25, 250 secured to a transverse bar 26, is pivoted at 2 to the ends of arms 3, 300 which are articulated at 16 to other levers 27, 270 interconnected by a transverse shaft 28 journaled in a yoke 29 that is swivelably carried by a sleeve 34. The latter supports through a fork 30 a hydraulic jack 14 which acts through a crank 33 on the shaft 28. The yoke 29 also carries a member 31 supporting a hydraulic jack 12 which is pivoted to a member 32 integral with the sleeve 34. The sleeve is supported by a member 35 integral with a shaft 37 journaled in a yoke 36 having a stem 39 which is rotatable on a shaft 390 fixed to the chassis of the carrier vehicle 4 by a base plate 46. The stem 39 has a fork 38 to which is connected a hydraulic jack 10 articulated to the sleeve 34. Also integral with the stem 39 is an arm 40 to which is articulated a hydraulic jack 8 whose other end is connected to the chassis 4 by a member 41. These various jacks and pivotal connections, a more detailed view of which is given in FIG. 2, impart to the frame 1 a certain number of degrees of freedom enabling it to execute various movements for loading the missiles onto a launching ramp.

The hydraulic jack 8 controls a swing of yoke 36 about a substantially vertical axis 7.

The hydraulic jack 10 controls a swing of sleeve 34 about a substantially horizontal transverse axis 9.

The hydraulic jack 12 controls a swing of yoke 29 about an inclinable longitidinal axis 11.

The hydraulic jack 14 controls a rotation of shaft 28 about an axis 13.

These various jacks are operated from a nonillustrated control desk installed on the loading vehicle 4 in order to bring the frame 1 into a position with respect to the launching ramp enabling the transfer of the missiles to the ramp.

For this purpose, the frame further carries two identical bars 42, 420 whose free ends terminate in hooks 5 and whose other ends are fixed to the yoke 29. These bars are engageable after a swinging of the frame about the mutually orthogonal axes 7, 9 and 11, with fittings fixed to the ramp and shown at 15 in FIGS. 3–9. When in the correct position, these hooking bars thus hitch the loading frame to the ramp and even out any differences between the position of the loader and the position of the ramp (relative to the ground) in cooperation with supporting and centering slideways 6, 600 which, in the course of the movements of the frame, slide on guiding pins 17 shown in FIGS. 3–8.

The missiles to be loaded are secured to the frame 1 by articulated cradles 19, 190, 191, 192, 193, 194, 195, 196 located on each face of the longitudinal members or shelves 25 and 250. These pivotable cradles are swingable by jacks partly illustrated at 21, 211, 212 acting through rods which have been designated 43, 430 in the case of the upper cradles. The rods controlling the lower cradles are not shown in the drawing. Each of these cradles carries locks 20 which hold the missiles or containers in position.

Figure 3:
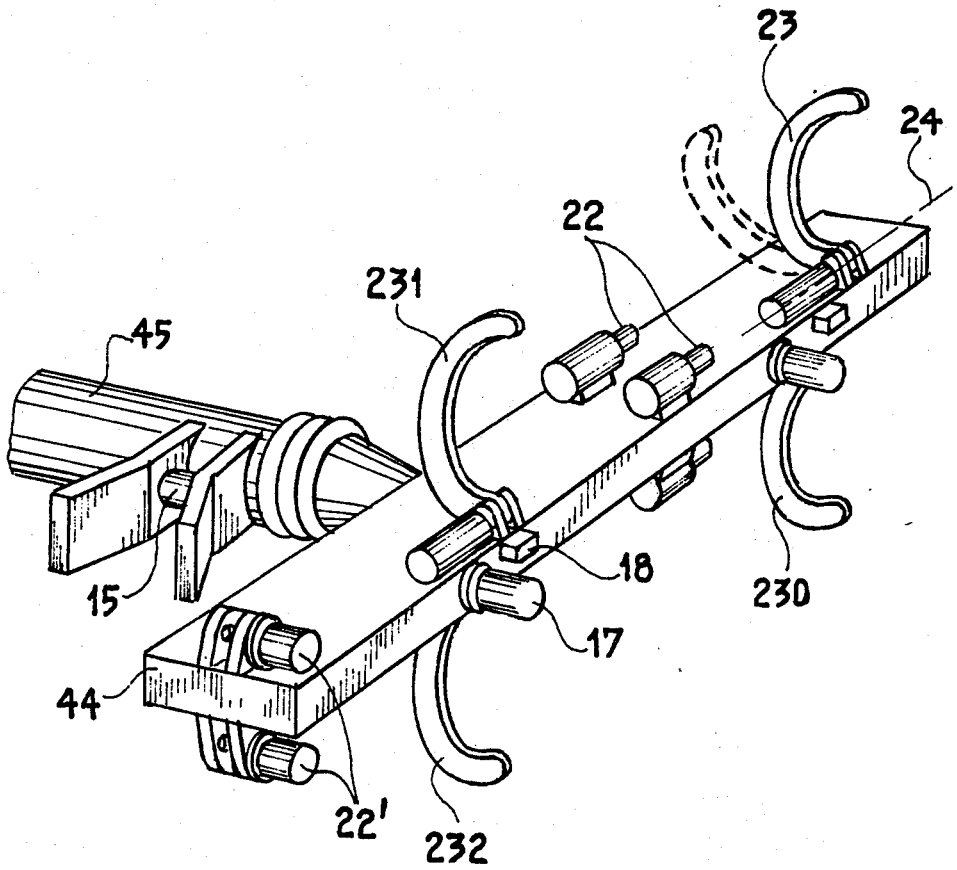
FIG. 3 is an isometric view of a launching ramp cooperating with the frame of FIGS. 1 and 2.

FIG. 3 is a diagrammatic view of the launching ramp carried by an associated vehicle. The ramp proper 44 is secured to a support or turret 45 of the carrier vehicle 47 (shown for example in FIG. 4). The support 45 carries one of the fittings 15 engageable by the hooks 5 of the frame 1 (FIG. 1). The ramp 44 is also provided, on each of its major surfaces, with two longitudinal locks 22 and one transverse lock 22' for securing a projectile container or a missile to that ramp surface. Guide pins 17 projecting from a longitudinal edge of the ramp; serve to support respective slideways 6, 600 of the frame. Stops 18 are also provided to arrest the sliding of the frame when it docks with the launching ramp. The upper and lower ramp faces carry pairs of semiannular receiving members 23, 230, 231, 232 pivotable about respective swing axes parallel to the longitudinal ramp edges, such as an axis 24, for the upper receiving members; these members assist in the fixing of the missiles by the locks 22, 22' during the loading of the ramp and, in the case of missiles transported in containers, permit the expulsion of the containers by a rapid unlocking when the missiles have been fired.

FIGS. 4 to 7 show the various stages of the loading of the missiles on their ramp.

Figure 4:
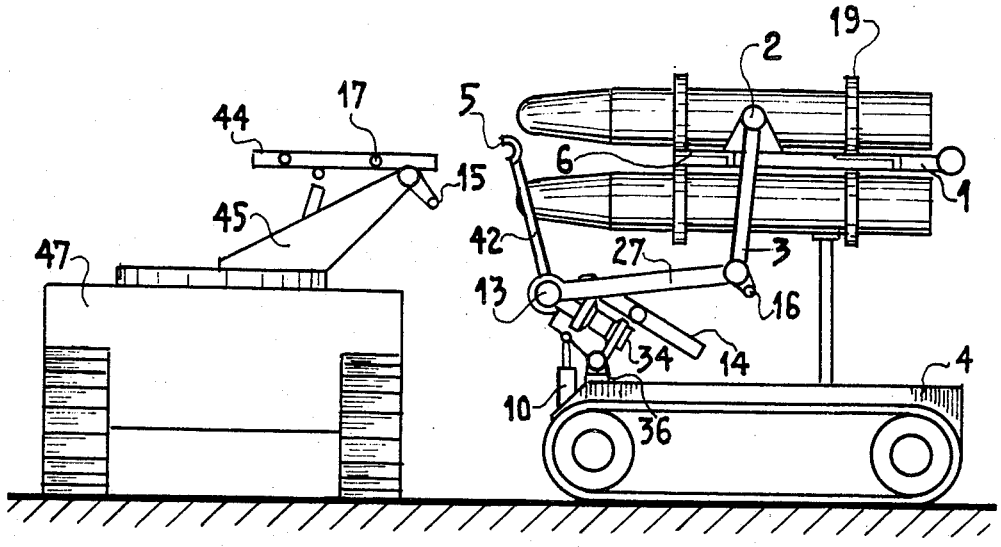
FIGS. 4, 5, 6 and 7 are side-elevational views of the assembly illustrating different stages of the passage of the missiles from the support frame to the launching ramp.
Figure 5:
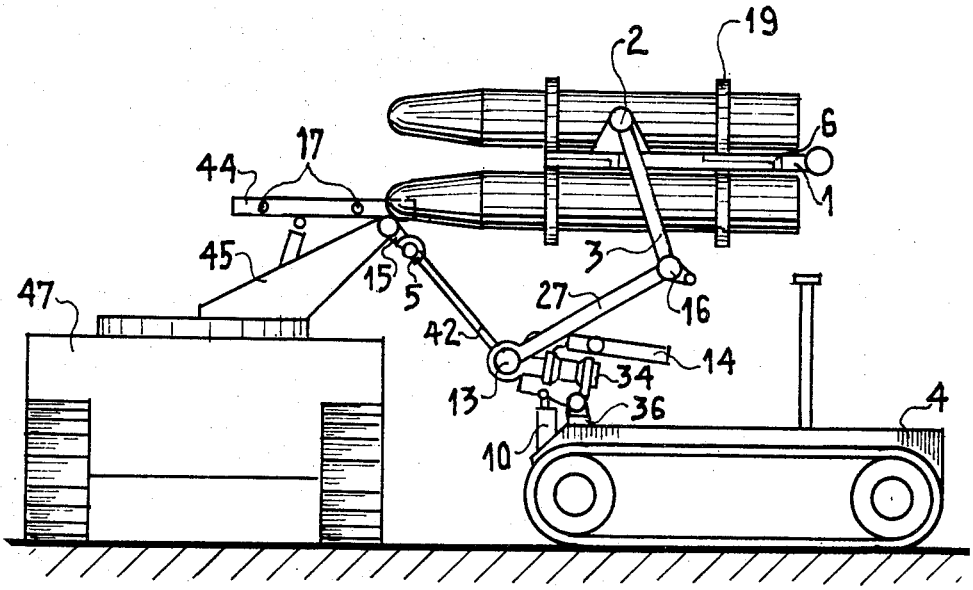

In FIG. 4, the carrier vehicle 4 is stopped in such a docking position perpendicular to the launching vehicle 47 that the various loading operations, i.e., the transfer of the missiles from the frame 1 of the vehicle 4 onto the ramp 44, can be carried out. In FIG. 4, with the articulation 16 locked to immobilize the arms 3, 300 with reference to links 27, 270, the frame 1 is raised by a swing of linkage 3, 27, 42 about the axis 13 under the control of the jack 14. In the course of this swing, during which the rising frame 1 undergoes a movement of translation toward the ramp, the bar 42 hooks itself to the fitting 15 of the ramp. This operation is the stage in which the frame 1 is hitched to the launching ramp as illustrated in FIG. 5.

Figure 6:
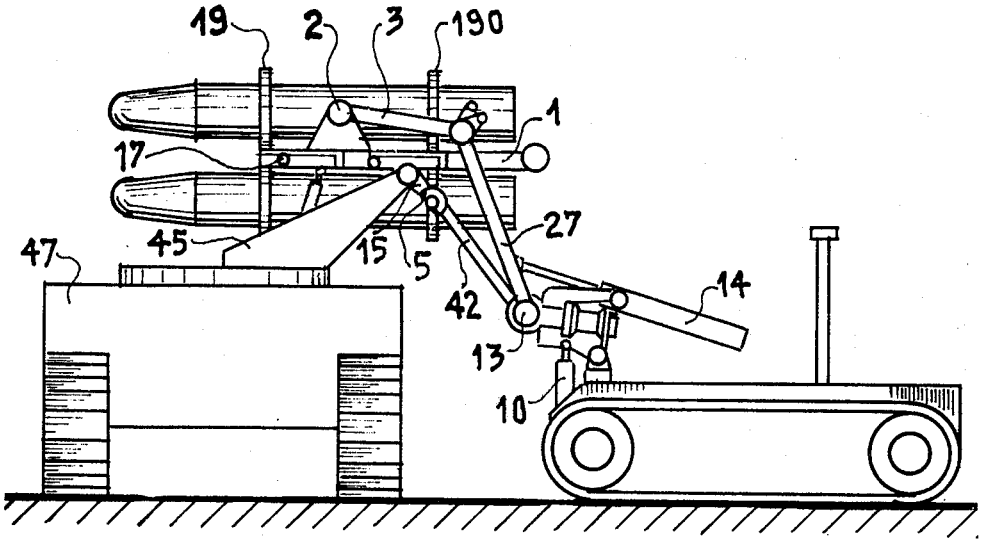

FIG. 6 shows the stage of the sliding of the frame 1 by its slideways 6, 600 on the guide pins 17 of the ramp after the articulation 16 has been unlocked.

Figure 7:
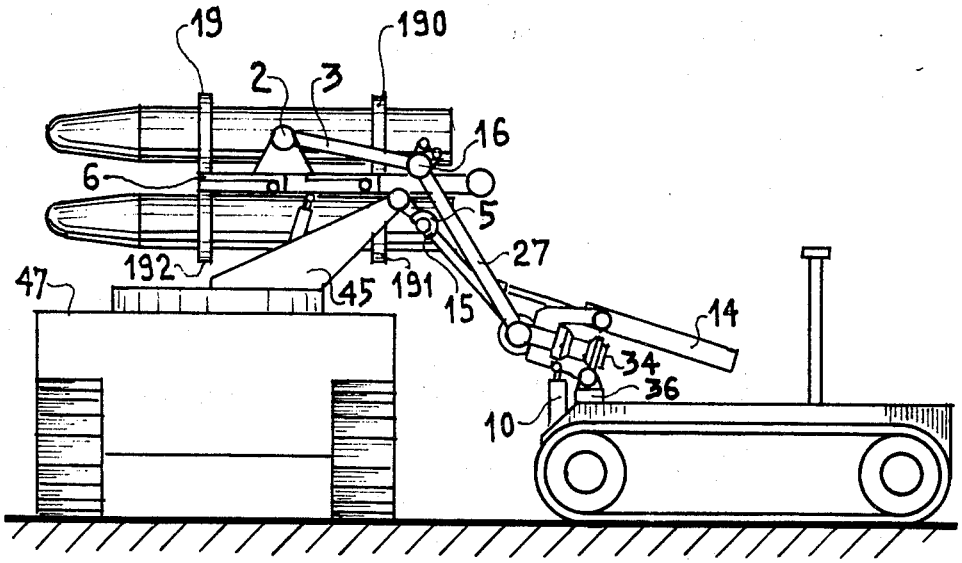

FIG. 7 shows the final alignment stage in which the frame 1 abuts the stops 18 of the ramp. The operation of transferring the missiles from the frame 1 to the launching ramp can now be carried out.

Figure 8:
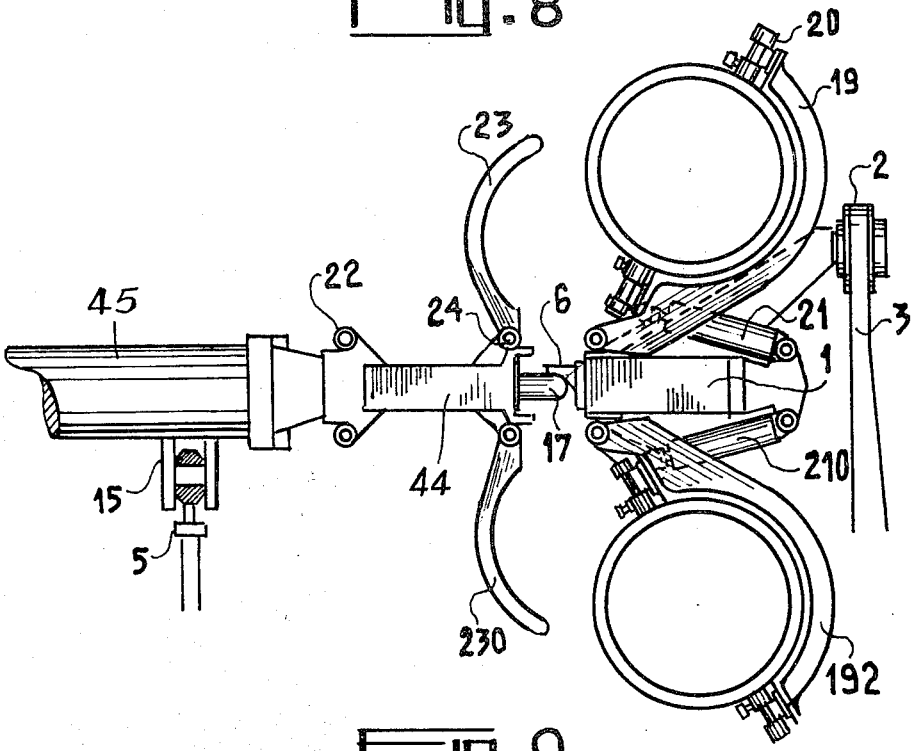
FIGS. 8 and 9 are detail views showing the final stage of the passage of the missiles from the frame to the launching ramp.

FIG. 8 shows the relative positions of the clamping elements fixing the missiles to the frame and the receiving elements on the launching ramp at the moment when, with the frame and the ramp hitched together, the missiles can be transferred from one support to the other.

Figure 9:
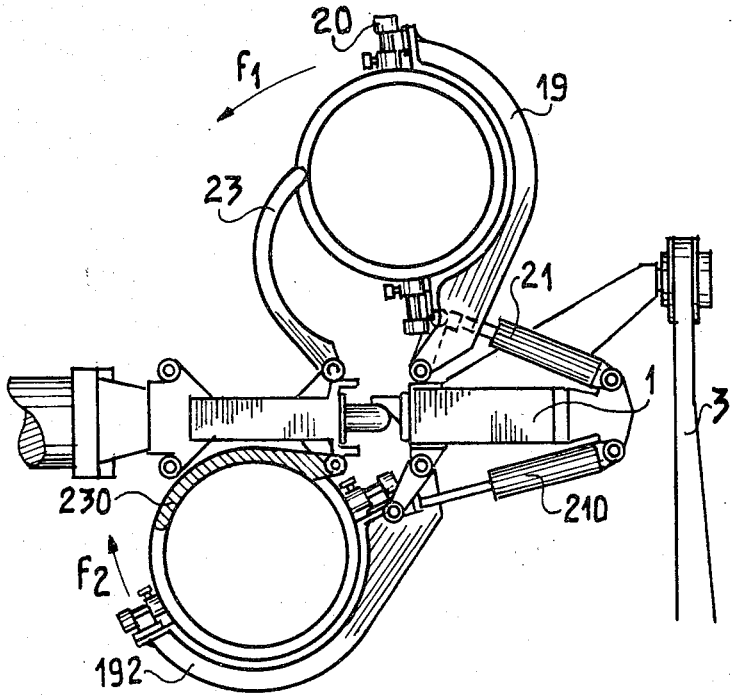

FIG. 9 shows how the transfer is carried out. Under the action of the jack 21, the cradle 19 pivots in the direction of arrow $f_1$ toward the ramp and urges back the spring-biased semicircular receiving member 23 which rotates about its axis 24 until it embraces the missile, which is still fastened to the frame 1 by the locks 20. The lower receiving member 230 is shown in this final transfer stage in which the missile is placed on its launching ramp and engaged by locks 22, 22' (FIG. 3), the locks 20 of the cradles 19 of the frame then being released. The loading vehicle, having transferred its missiles to the launching ramp, can move away from the launching vehicle and the missiles are ready to be fired.

Though we have illustrated only one ramp 44 serving to receive one of the two missle pairs carried by the shelves 25, 250, it will be evident from the symmetrical frame construction shown in FIG. 1 that two such ramps are introduced into the open side of frame 1 during the docking maneuver and that both carry, along their outer longitudinal surfaces, formations 17 coacting with formations 6, 600 on the inner frame edges to support the shelves in their translational movement, between the positions of FIGS. 6 and 7, under the thrust of arms 3, 300 after their joints 16 have been unlocked as described above.

What is claimed is:

1. A semi-automatic loading system for a weapon having at least one launching ramp provided with at least one generally horizontal projectile-receiving surface, comprising:

a projectile holder including an elongate member having at least one generally horizontal projectile-carrying surface alignable with said projectile-receiving surface;

a carrier for said holder positionable adjacent said weapon;

mounting means supporting said holder on said carrier with freedom of independent rotation about three mutually orthogonal axes to facilitate a positioning of said member alongside said ramp;

releasable clamping means on said projectile-carrying surface for retaining a projectile to be transferred to said projectile-receiving surface, said clamping means being pivotable about a swing axis parallel to a longitudinal edge of said member for delivering said projectile to said projectile-receiving surface; and actuating means for pivoting said clamping means about said swing axis upon alignment of said surfaces with each other.

2. A system as defined in claim 1 wherein said clamping means comprises a plurality of longitudinally spaced-apart cradles provided with projectile-engaging locks.

3. A system as defined in claim 1 wherein said carrier is a vehicle.

4. A system as defined in claim 1 wherein said member is a shelf with upper and lower projectile-carrying surfaces, said clamping means being duplicated on both said projectile-carrying surfaces.

5. A system as defined in claim 4 wherein said shelf is one of two substantially identical and parallel shelves forming part of a generally horizontal frame open at one side, said shelves being rigidly interconnected at the opposite side of the frame, said clamping means being symmetrically mounted on said shelves for coaction with ramps introduced into said frame through its open side.

6. A system as defined in claim 5 wherein said mounting means comprises a pair of links on opposite sides of said frame interconnected for swinging about a horizontal axis transverse to said shelves, gripping means rigid with said links engageable with said weapon in a docking position of said carrier, and a pair of arms pivoted to said frame and articulated to said links by lockable joints for placing said shelves alongside said ramps, said shelves and said ramps being provided with coacting formations for slidably guiding said shelves along said ramps in a final alignment stage in which said joints are unlocked to facilitate the sliding motion of said shelves.

7. A system as defined in claim 6 wherein said ramps are provided with stops for limiting said sliding motion.

8. A system as defined in claim 6 wherein said coacting formations are a plurality of laterally projecting pins on said ramps and lateral slideways on said shelves coming to rest on said pins.

9. A system as defined in claim 6 wherein said mounting means further comprises a base plate, a first yoke rotatable on said base plate about a vertical axis, a first horizontal shaft transverse to said shelves journaled on said first yoke, and a second yoke swivelable on said shaft about a longitudinal axis transverse to said shaft, said links being interconnected by a second horizontal shaft journaled in said second yoke.

10. A system as defined in claim 9, further comprising a plurality of fluid-operated jacks for rotating said first yoke about said vertical axis, turning said shaft about its own axis together with said second yoke, and swiveling said second yoke about said longitudinal axis.

* * * * *